US009534838B2

(12) United States Patent
Rae et al.

(10) Patent No.: US 9,534,838 B2
(45) Date of Patent: Jan. 3, 2017

(54) INK CURING APPARATUS

(71) Applicant: GEW (EC) Limited, Crawley (GB)

(72) Inventors: Malcolm Rae, Crawley (GB); James Hicks, Crawley (GB)

(73) Assignee: GEW (EC) LIMITED, Crawley (GB)

( * ) Notice: Subject to any disclaimer, the term of this patent is extended or adjusted under 35 U.S.C. 154(b) by 0 days.

(21) Appl. No.: 14/707,757

(22) Filed: May 8, 2015

(65) Prior Publication Data

US 2015/0323251 A1 Nov. 12, 2015

(30) Foreign Application Priority Data

May 8, 2014 (GB) ..... 1408136.8

(51) Int. Cl.

| | |
|---|---|
| ***G21K 5/04*** | (2006.01) |
| ***F26B 3/28*** | (2006.01) |
| ***G21K 5/02*** | (2006.01) |
| ***B41F 23/04*** | (2006.01) |
| ***B41J 11/00*** | (2006.01) |

(52) U.S. Cl.

CPC ..... *F26B 3/28* (2013.01); *B41F 23/0409* (2013.01); *B41F 23/0453* (2013.01); *B41J 11/002* (2013.01); *G21K 5/02* (2013.01)

(58) Field of Classification Search

USPC ..... 250/492.1, 493.1, 494.1, 504 R; 34/274, 34/277, 278

See application file for complete search history.

(56) References Cited

U.S. PATENT DOCUMENTS

| | | | | |
|---|---|---|---|---|
| 3,819,929 | A | 6/1974 | Newman | |
| 3,914,594 | A * | 10/1975 | Helding | F26B 3/28 362/218 |
| 5,502,310 | A | 3/1996 | Niestrath et al. | |
| 6,191,428 | B1 * | 2/2001 | Gilberti | A61L 2/10 250/493.1 |

FOREIGN PATENT DOCUMENTS

| | | | |
|---|---|---|---|
| CN | 202573312 | U | 12/2012 |
| CN | 103223399 | A | 7/2013 |
| DE | 10109061 | A1 | 10/2001 |
| DE | 102008058056 | A1 | 7/2010 |
| GB | 1482743 | A | 8/1977 |
| GB | 2258296 | A | 2/1993 |
| GB | 2311840 | A | 10/1997 |
| GB | 2336895 | A | 11/1999 |
| GB | 2495161 | A | 8/2013 |
| WO | 2008/073338 | A2 | 6/2008 |
| WO | 2013/021184 | A1 | 2/2013 |
| WO | 2014/038301 | A1 | 3/2014 |

* cited by examiner

*Primary Examiner* — Nicole Ippolito
(74) *Attorney, Agent, or Firm* — Nixon Peabody LLP

(57) ABSTRACT

An ink curing apparatus (1) comprising a UV lamp (9); at least two reflectors (5, 7); and at least one continuously moveable shutter (11*a*, 11*b*), wherein the movement of the or each shutter (11*a*, 11*b*), between an open position exposing a substrate to UV radiation from the UV lamp (9) and a closed position wherein the shutter (11*a*, 11*b*) shields the substrate from the UV radiation from the UV lamp, is controlled by a crank mechanism (20, 21, 22, 24, 25, 26).

13 Claims, 7 Drawing Sheets

INK CURING APPARATUS

CROSS REFERENCE TO RELATED APPLICATIONS

This application claims priority under 35 U.S.C. 119(b) of Great Britain Application Serial No. 1408136.8 filed May 8, 2014, the contents of which are incorporated herein by reference in their entirety.

FIELD OF THE INVENTION

The present invention relates to an ink curing apparatus and method; and an improved shutter for the ink curing apparatus.

BACKGROUND OF THE INVENTION

Ink curing apparatus, comprising a housing containing a lamp partially surrounded by reflectors to direct UV radiation onto a substrate to cure ink, are well-known. Existing ink curing apparatus use reflectors to direct UV radiation from the lamp onto a substrate. The lamp is commonly surrounded by a moveable shutter. The shutter functions as a safety device, whereby when the apparatus is stopped and the power to the lamp is reduced the shutter is closed to shield the substrate from the heat of the lamp. When the power is reduced, any residual heat held in the lamp is retained within the apparatus, including being absorbed by the shutter. The shutter is opened to allow UV radiation to be directed through the opening between the reflectors, referred to as a "curing window", onto the substrate.

Known shutter arrangements for UV curing apparatus include a single curved plate, or two complementary curved plates that meet each other when the shutter is in a closed position, to block radiation from the lamp reaching the substrate. The applicant's earlier UK Patent GB2495161 describes the use of such shutters in UV curing apparatus, wherein each of two shutters holds in place a reflector. Each shutter is moveable between an open position exposing the substrate to UV radiation and a closed position shielding the substrate from the UV lamp. Movement of the shutter/s in known devices is often generated by using an actuator, which is pneumatically or electrically powered; for example, shutter movement is controlled by a pneumatic drive having an actuator limited to a 180-degree field of movement. The pneumatic drive is used to move the two shutters together into a closed position and then apart into an open position. In alternative embodiments, an electric motor is used. Known drive means move in one direction to open the shutters and in the opposite direction to close the shutters. Thus, known devices only allow movement of the shutters between two discrete positions, whereby the curing window is either open or closed. The movement of the shutter is slow and, in some arrangements, it has been found that the shutter can effectively jolt between the two alternative positions. Furthermore, the stop-start movement of existing shutter mechanisms puts a significant amount of stress on the component parts of the apparatus.

Existing drive mechanisms are difficult to control to allow shutter movement with the desired accuracy and speed. The movement of a shutter/s having the above-described problems has been found to be particularly disadvantageous in the field of digital/inkjet UV print curing where the printing process is much quicker with the substrates for curing being moved rapidly through the UV curing apparatus. Slow and poorly-controlled shutter movement is a significant limitation to the speed and output volume of the digital print process.

SUMMARY

The present invention sets out to provide an improved UV ink curing apparatus and method, which alleviates the problems described above to provide an improved shutter arrangement.

In one aspect, the invention provides an ink curing apparatus comprising a UV lamp; at least two reflectors; and at least one continuously moveable shutter, wherein the movement of the or each shutter, between an open position exposing a substrate to UV radiation from the UV lamp and a closed position wherein the shutter shields the substrate from the UV radiation from the UV lamp, is controlled by a crank mechanism.

Preferably, the crank mechanism comprises at least two links attached to a rotatable shaft; more preferably a first link is connected to a first shutter and a second link is connected to a second shutter.

Preferably, the length of the first link is less than the length of the second link.

The crank mechanism of the present invention allows for conversion of motion generated by a drive means, such as a motor, to movement of the shutter. The crank mechanism allows for much improved speed and control of the shutter; increases the speed and efficiency of the UV curing process; and allows for the continual movement of the shutter during a print curing operation. The continual movement of the crank mechanism of the present invention significantly reduces the stress exerted on the moving parts of the apparatus. It has been found that the continual movement of the crank mechanism and associated reduction in stress on the moving parts significantly reduces the cost and time of maintenance. This reduces any down-time when the ink curing apparatus would need to be "powered down" to maintain or replace component parts; for example of the motor.

Preferably, the ink curing apparatus comprises two shutters.

Preferably, each link of the crank mechanism is attached to a connector, wherein each connector is attached to a shutter.

Preferably, the length of a first connector attached to a first shutter is greater than the length of a second connector attached to a second shutter.

Preferably, the rotatable shaft of the crank mechanism is movable in a clock-wise and an anti-clockwise direction.

Preferably, rotation of the rotatable shaft of the crank mechanism in a single direction is configured to move the two shutters both towards and away from each other.

The configuration of the rotatable shaft; the connector; and the shutters is such that the rotatable shaft need only be moved in a single direction of rotation to continuously open and close the shutters. This eliminates the need to stop and re-start the movement mechanism; i.e. to reverse the direction of rotation. This provides an advantageous continuous movement, which increases the speed of production and reduces stress on moving parts.

Optionally, the or each shutter has a curved profile.

Preferably, the or each shutter has a substantially elliptical profile.

Preferably, a first shutter at least partially overlaps with a second shutter in a closed position.

It has been found that providing a first and a second shutter that partially overlap each other allows the substrate to effectively be 'blind', i.e. fully concealed, with respect to radiation emitted from the lamp.

Preferably, the crank mechanism is configured to move a first shutter slower than a second shutter.

Preferably, the crank mechanism is configured to reduce the speed of movement of the or each shutter when approaching the open and/or closed position.

By reducing the speed of movement of the or each shutter at the points of greatest stress on the movement mechanism, the wear on the moving parts and any associated risk of failure is greatly reduced.

Preferably, the angles of the crank mechanism are arranged to provide repeatable movement of the or each shutter.

Preferably, each reflector is connectable to a shutter.

More preferably, each reflector is removably connected to a shutter.

Easy removal of the reflector from the apparatus reduces the time and cost in maintaining the apparatus.

In a second aspect, the invention provides a UV ink curing method comprising the steps of;

a. moving at least one shutter using a crank mechanism to an open position wherein a substrate is exposed to UV radiation;

b. emitting UV radiation from a UV lamp;

c. directing the UV radiation using at least two reflectors onto the substrate to be cured, d. moving the or each shutter using the crank mechanism to a closed position wherein the substrate is shielded from the UV radiation emitted from the UV lamp, e. wherein movement of the crank mechanism and the associated movement of the or each shutter is continuous.

Continuous movement of the crank mechanism and so the shutters allows for optimisation of production speeds, whilst ensuring that the desired curing is achieved without any risk of excessive heating of the substrate.

More preferably, the ink curing method reduces the speed of movement of the or each shutter when approaching the open and/or closed position.

Preferably, the method comprises moving two shutters wherein a first shutter moves slower than a second shutter.

Preferably, movement of the crank mechanism is computer-controlled.

Preferably, movement of the crank mechanism is stoppable at any point between the open and closed position.

By stopping the crank mechanism and so the shutter and/or reflector means that the size of the curing window and the position of the shutter/reflector arrangement can be carefully controlled to allow for different curing effects to be achieved.

More preferably, movement of the crank mechanism is remotely controlled.

Preferably, the ink curing method further comprises the steps of moving the at least two reflectors in combination with the shutters using the crank mechanism.

For the purposes of clarity and a concise description, features are described herein as part of the same or separate embodiments; however it will be appreciated that the scope of the invention may include embodiments having combinations of all or some of the features described.

BRIEF DESCRIPTION OF THE DRAWINGS

The invention will now be described by way of example with reference to the accompanying diagrammatic drawings, in which:—

DETAILED DESCRIPTION

Figure 1:
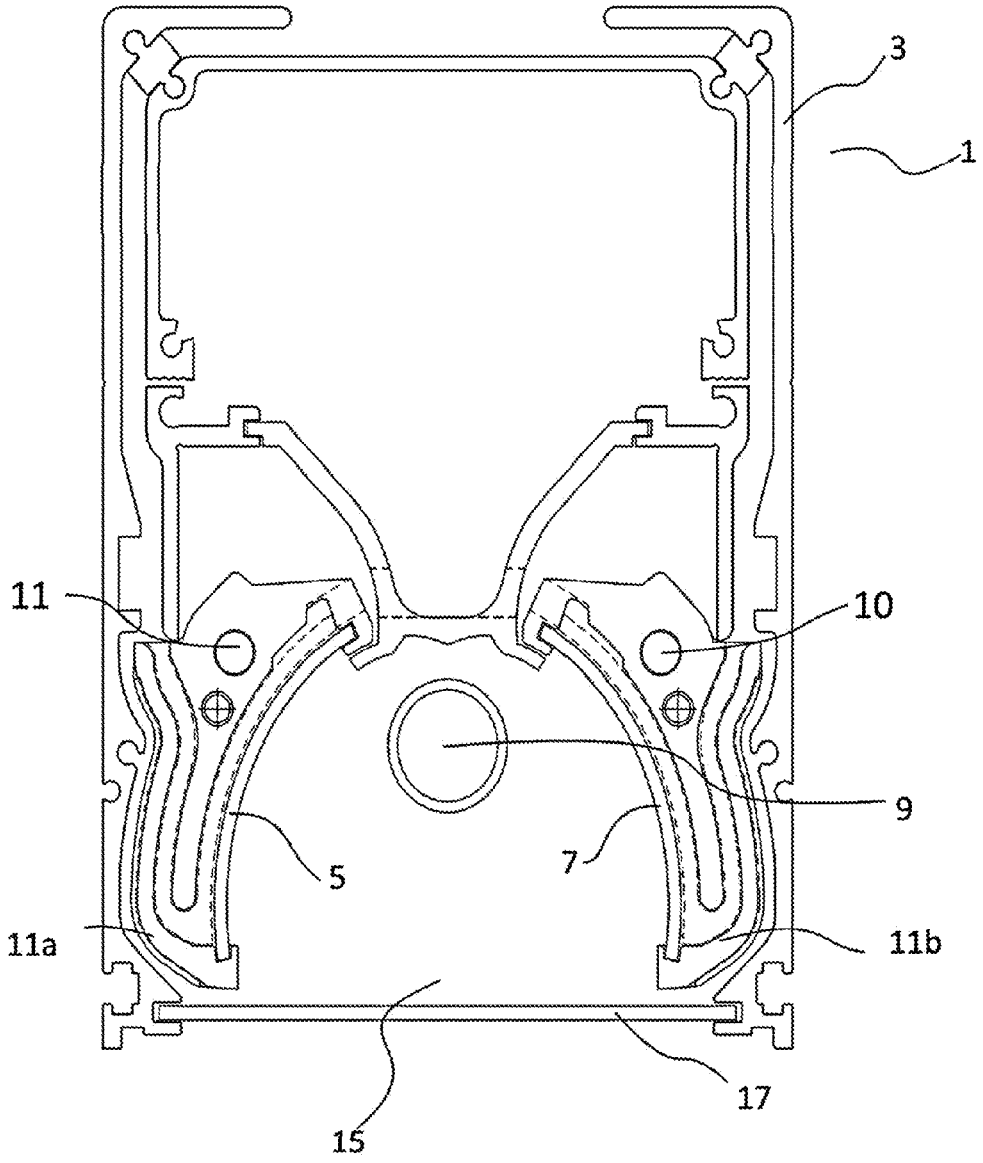
FIG. 1 is a cross-sectional view through an ink curing apparatus constructed in accordance with the present invention.

Referring to FIG. 1, the ink curing apparatus 1 comprises a housing 3. The housing contains two reflectors 5, 7 and a recess for housing a UV lamp 9. The lamp 9 is partially surrounded by the reflectors 5, 7. Two moveable shutters 11*a*, 11*b* are rotatable around their respective axis 10, 11. Each shutter 11*a*, 11*b* has a curved profile and is moveable between an open position and a closed position. In the embodiment shown in FIG. 1, each of the reflectors 5, 7 is removably connected to a shutter 11*a*, 11*b* such that opening and closing of the shutter 11*a*, 11*b* also moves the reflectors 5, 7 around the UV lamp 9. Each shutter 11*a*, 11*b* also acts as a holder for the reflector 5, 7 to which it is connected.

In an open position, as shown in FIG. 1, the substrate (not shown) to be cured is exposed to radiation from the UV lamp 9 through a "curing window" 15. The curing window 15 is defined below the UV lamp 9 and between the reflectors 5, 7. A quartz plate 17 can be used, which extends across the base of the housing 3. In use, UV radiation passes through the (optional) quartz plate 17 to the substrate, whilst the quartz plate 17 prevents the ingress of contaminants into the apparatus 1.

In a closed position, the moveable shutters 11*a*, 11*b* surround the UV lamp 9 at the base of the apparatus 1. The shutters 11*a*, 11*b* shield the substrate from the UV lamp 9 when the apparatus 1 is not in use, or when the apparatus is in "stand by" mode.

Referring to FIGS. 2A-2D the shutter movement provided for by the present invention is described in terms of the movement of the reflectors 5, 7. As shown in FIG. 1, the shutters 11*a*, 11*b* are integral with the reflectors 5, 7 and so would move in the same manner as the reflectors shown in FIGS. 2A-2D.

Figure 2A:
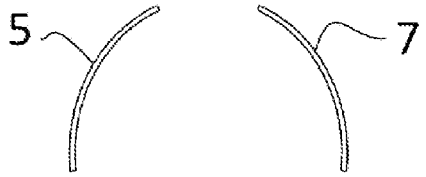
FIGS. 2A-2D are schematic cross-sectional views of the reflector/shutter arrangement of the present invention caused by rotation of the actuator (rotatable shaft) in an anti-clockwise direction.
Figure 2B:
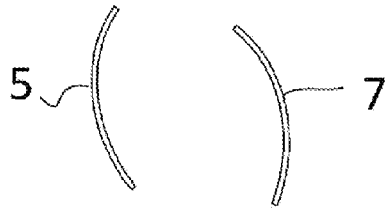
Figure 2C:
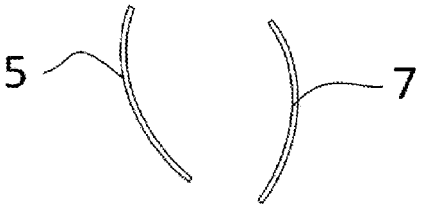
Figure 2D:
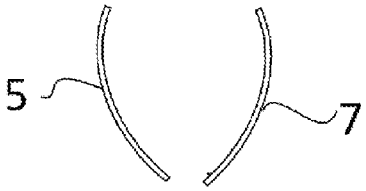
Figure 4A:
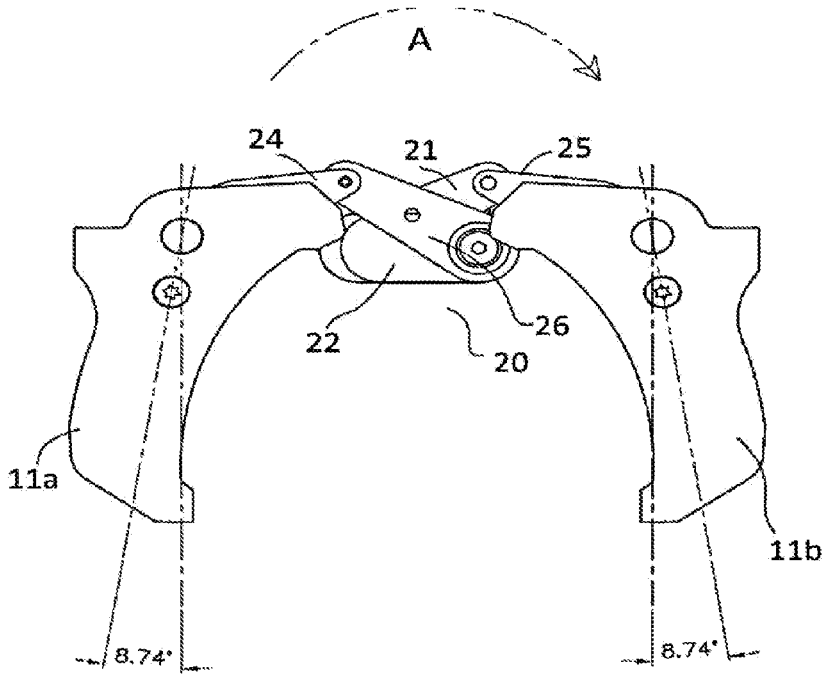
FIGS. 4A-4F are schematic cross-sectional views of the crank mechanism and shutters moving between an open and a closed position, showing rotation of the actuator (rotatable shaft) in a clockwise direction at 0° (fully open), shown in FIG. 4A; 36°, shown in FIG. 4B; 72°, shown in FIG. 4C; 108°, shown in FIG. 4D; 144°, shown in FIG. 4E and 180° (fully closed), shown in FIG. 4F.
Figure 4B:
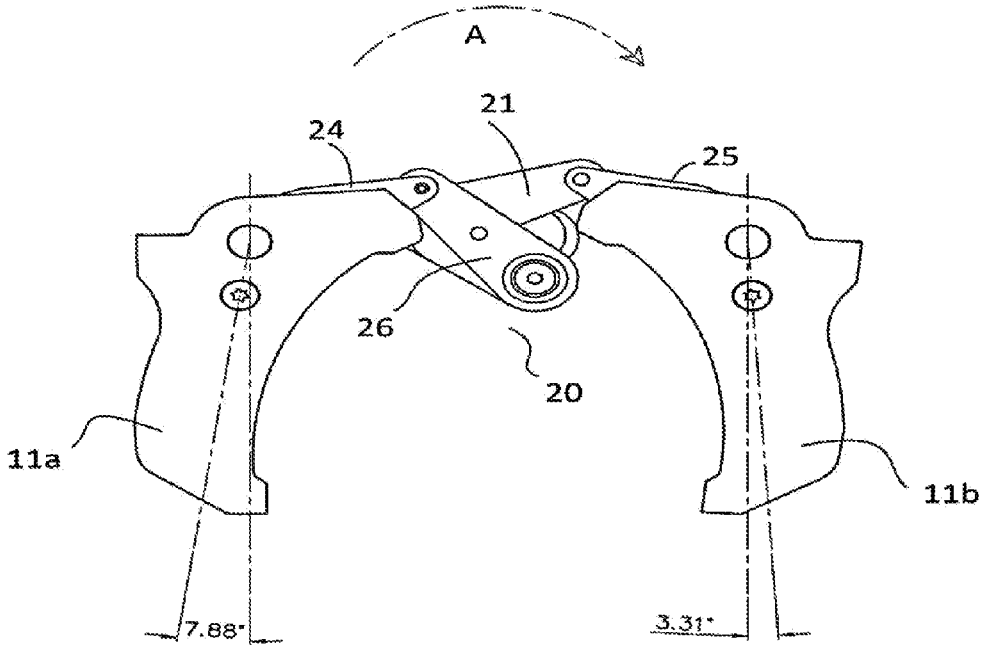
Figure 4C:
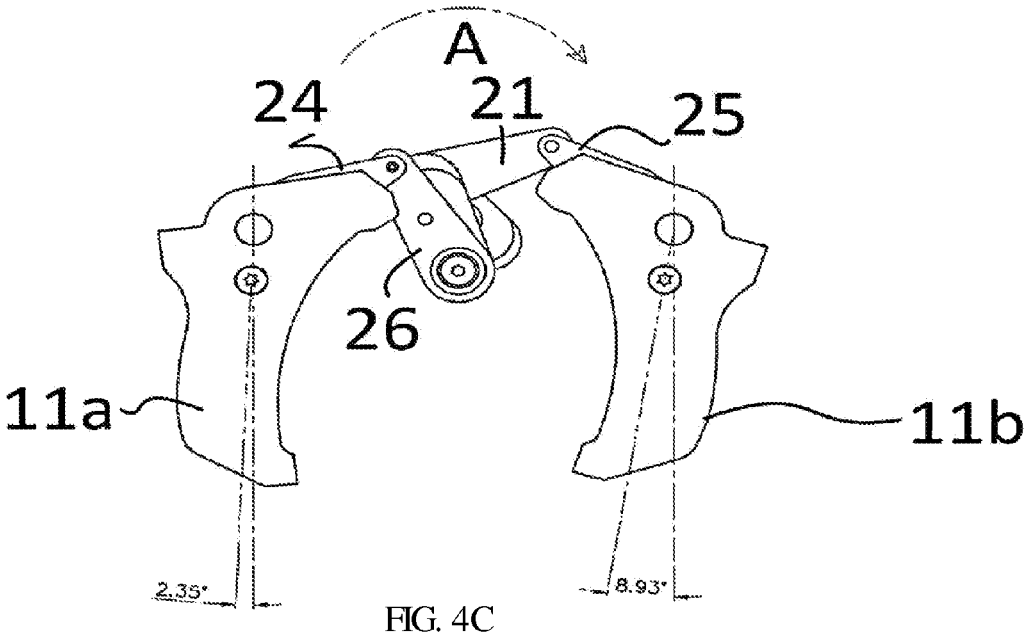
Figure 4D:
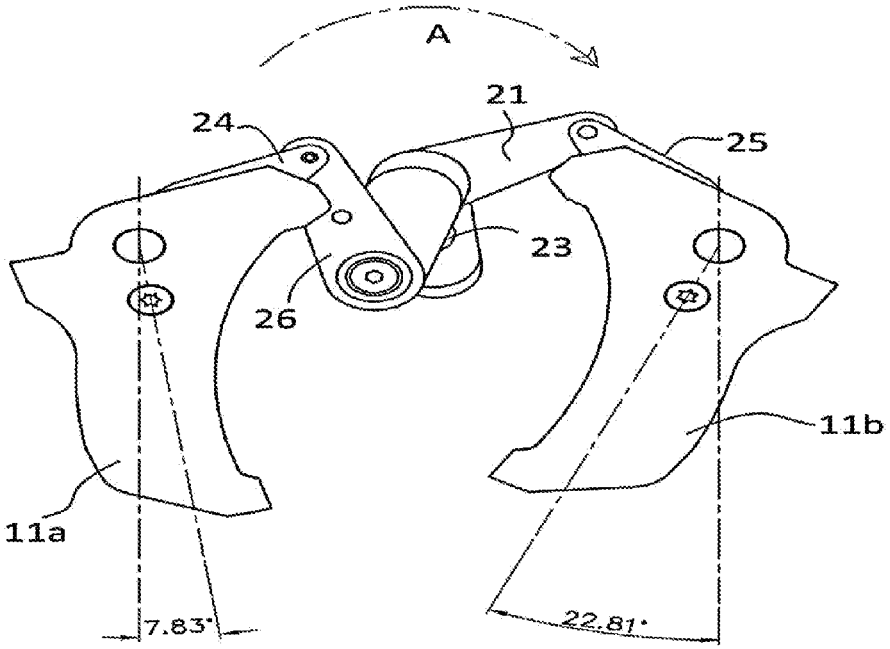

As shown in FIG. 1 and FIGS. 2A-2D the reflectors 5, 7 are elliptical in shape and move between an open position, as shown in FIG. 2A and a closed position, as shown in FIG. 2D. As shown in FIG. 1, each shutter 11*a*, 11*b* is closer to the curing window than each reflector 5, 7. In the closed position, which is also shown in FIG. 4F, the shutters 11*a*, 11*b* partially overlap, with the tip of a first shutter 11*a* meeting the inner face of a second shutter 11*b*. As shown in FIGS. 2A-2D, movement of the reflectors and shutters is not symmetrical about the axis of rotation 10. In the embodiment shown, to achieve the partial overlap, the second shutter 11*b* moves more slowly than the first shutter 11*a*. In alternative embodiments, the degree of overlap and the speed of each shutter can vary. The speed at which each shutter moves is carefully controlled by the configuration of the crank mechanism 20.

Referring to FIGS. 3A-3D, movement of the shutters and reflectors 5, 7 is controlled by a crank mechanism 20. The crank mechanism 20 comprises two links 21, 26 that are both attached to arm 22, which is attached to a rotatable shaft 23. Each link 21, 26 is attached to a connector 24, 25. Each of the connectors 24, 25 is connected to a shutter/reflector arrangement 7, 9, 11*a*, 11*b*, which is rotatable about an axis 10, 11, as described with reference to FIG. 1. It is understood that alternative shutter/reflector arrangements for use in UV curing apparatus may also include the crank mechanism 20 of the present invention. For example, in alternative embodiments of the present invention, the crank mechanism herein described may be used to move a single or two-piece shutter independently of the movement of the reflector/s.

Referring to FIGS. 2A-2D and FIGS. 3A-3D, in use, a motor (not shown) drives rotation of the rotatable shaft 23. Rotation of the shaft 23 is converted by the connector 24, 25 connected to links 21, 26 into the required movement of the reflector/shutter arrangement 5, 7, 11*a*, 11*b*. The reflector/shutter arrangement 5, 7, 11*a*, 11*b* moves in a direction concentric to the axis of the shafts 10, 11.

Figure 3A:
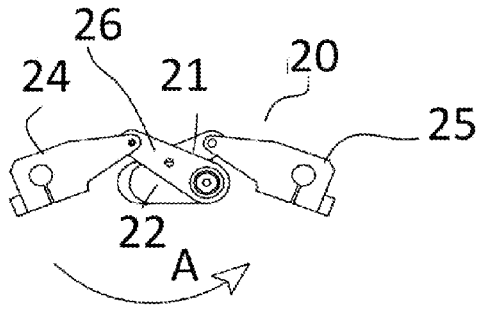
FIGS. 3A-3D are schematic views of the crank mechanism of the present invention.
Figure 3B:
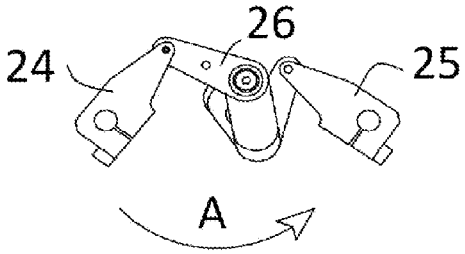
Figure 3C:
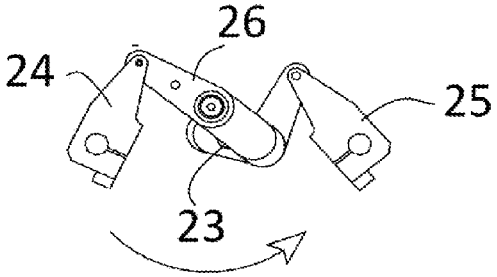

As shown in FIGS. 2A and 3A, with the reflectors 5, 7 in an open position, the shaft 23 of the crank mechanism 20 is rotated (A) through 180-degrees to move the reflectors 5, 7 to a closed position, as shown in FIG. 2D. The rotatable shaft 23 of the crank mechanism 20 can be rotated in either direction, i.e. clockwise or anticlockwise. Movement of the crank mechanism 20 in either direction will cause movement of the reflector/shutter arrangement between an open and closed position and all positions throughout the cycle. Thus, the movement of the shutters 11*a*, 11*b* is always smooth and continuous between a start and an end position as predetermined by the user.

The configuration of the crank mechanism 20 ensures that the speed of movement of the shutter/reflector arrangement reduces when approaching the fully-open or fully-closed position. The rotation of the crank mechanism is continuous, i.e. the movement of the shutter/reflector arrangement does not stop unless the apparatus is powered down for print curing operation to cease. The ink curing apparatus 1 is configured so that the actuator and so the crank mechanism 20 and the shutter 11*a*, 11*b* are continuously moving during print curing.

Figure 3D:
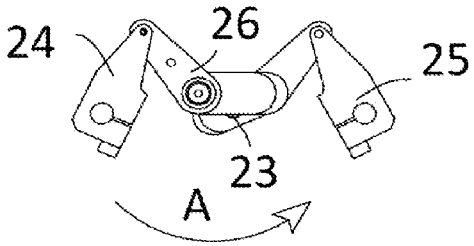

After the shutters have reached the fully closed position, shown in FIG. 3D the rotatable shaft 23 continues to rotate about its axis in the same direction. The rotation moves the crank mechanism 20 to gradually open the shutters 11*a*, 11*b* until the shutters 11*a*, 11*b* are in the fully open position again, as shown in FIG. 2A.

However, depending on a user's requirements it is also possible for the crank mechanism 20 to be stopped in a fully-closed position, shielding the substrate from UV radiation, between print cycles.

Control of the movement of the crank mechanism 20 of the present invention is computer-implemented to allow the shutters to be stopped at any pre-determined point through the cycle of opening and closing. Monitoring and controlling the shutter position allows for more accurate control of the size of the curing aperture and the position of the reflectors 5, 7 that are attached to the shutters 11*a*, 11*b*. For example, to achieve different curing effects it may be desirable to stop the shutter/reflector arrangement at the partially-closed positions shown in FIG. 2B or FIG. 2C. In these intermediate positions, UV radiation from the UV lamp will be reflected onto the substrate in a different manner and different print curing effects will be achieved. It is envisaged that in alternative embodiments of the present invention, an encoder may be used to monitor the movement of the crank mechanism 20 and so the position of the reflector/shutter arrangement.

Referring to FIGS. 4A-4F, movement of the rotatable shaft 23 of the crank mechanism 20 is shown with the actuator (motor) moving the rotatable shaft 23 in a clockwise direction. FIGS. 4A-4F show movement of the shutters 11*a*, 11*b* at various stages (0°, 36°, 72°, 108°, 144°, 180°) through a cycle between the shutters 11*a*, 11*b* being fully open (at 0° of rotation), in FIG. 4A, to fully closed (at 180° rotation), in FIG. 4F.

Using like reference numerals to indicate like parts, the actuator rotates to move the rotatable shaft 23 and so the crank mechanism 20 continuously, which simultaneously moves both shutters 11*a*, 11*b*. With reference to FIGS. 4A-4B, a motor (not shown) drives continuous rotation of the rotatable shaft 23 through 36°. This 36° rotation of the shaft 23 is converted by the connector 24, 25 connected to links 21, 26 into the required movement of each shutter 11*a*, 11*b*. The first shutter 11*a* moves 0.86° (with reference to a vertical axis) towards the second shutter 11*b*. The second shutter 11*b* moves 5.43° (with reference to a vertical axis) towards the first shutter 11*a*.

Figure 4E:
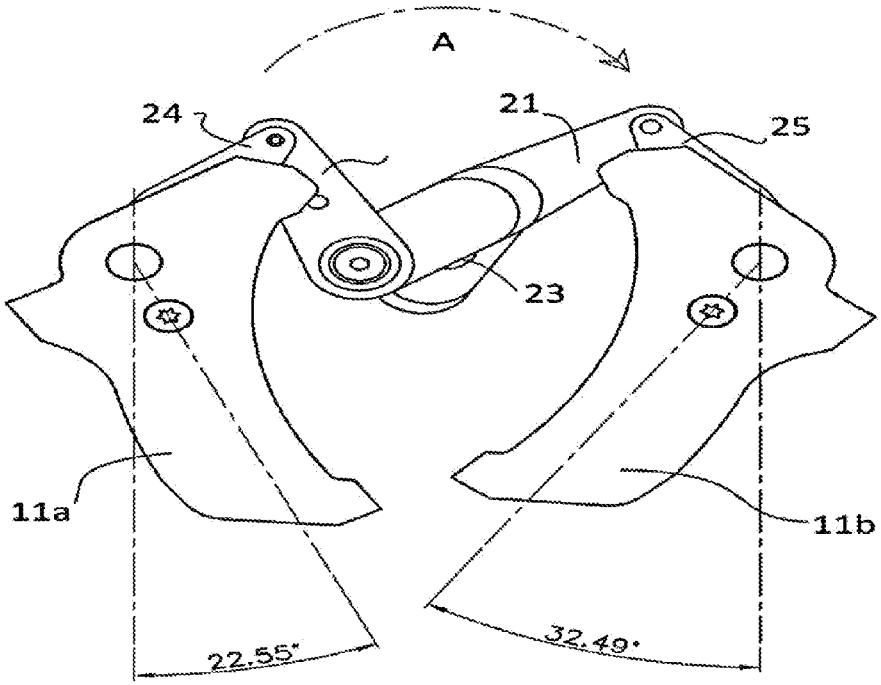
Figure 4F:
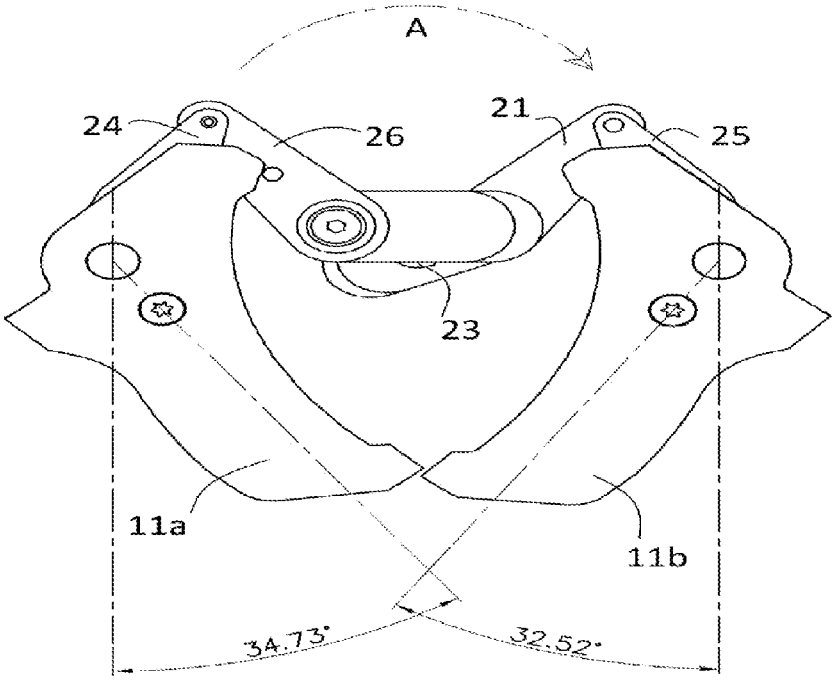
Figure 5:
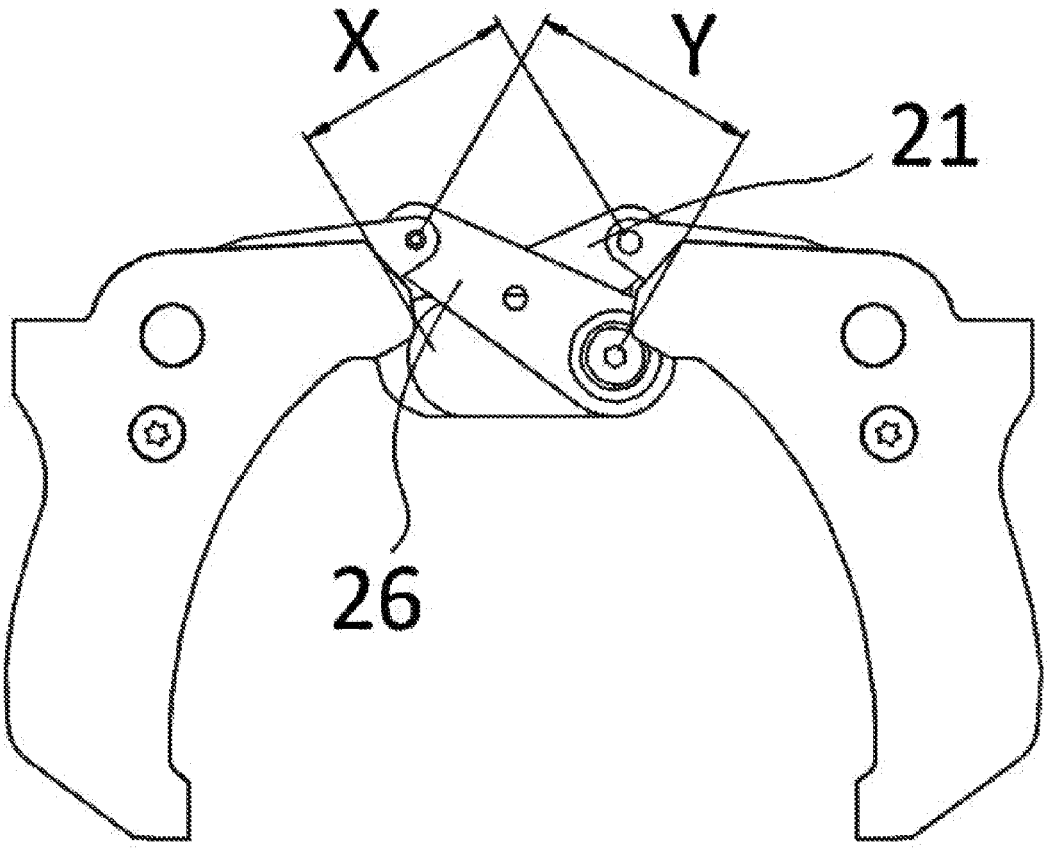
FIG. 5 is a cross-sectional view of the crank mechanism of the present invention, showing the shutters in an open position and indicating the lengths of a first and second link or arm.

Referring to FIG. 5, the length of the first link or arm 21, which connects to the first shutter 11*a*, is different from the length of the second link or arm 26, which connects to the second shutter 11*b*. The mounting point of each link 21, 26 is at a different radius from the centre axis of the crank mechanism 20; i.e. the axis of the rotatable shaft 23. The length (X) of the first link 21 is less than the length (Y) of the second link 26. The different lengths and the geometry of the mounting points of the first and second links/arms 21, 26 causes the first and second shutter 11*a*, 11*b* to move independently from each other and at different speeds. As shown in FIGS. 4A-4F the differing speeds cause a different range of movement for the first and the second shutter 11*a*, 11*b* through each stage of the open-close-open cycle.

Referring to FIG. 4B, for a given rotation (36°) of the rotatable shaft 23, the first shutter 11*a* has moved through an angle of rotation of about 0.86°, whilst the second shutter 11*b* has moved through an angle of rotation of about 5.43°.

Within this specification, the term "about" means plus or minus 20%, more preferably plus or minus 10%, even more preferably plus or minus 5%, most preferably plus or minus 2%.

The movement of each shutter 11*a*, 11*b* is shown in FIGS. 4A-4F as the rotatable shaft 23 moves, in a clockwise direction, from 0° (fully open), to 36°, to 72°, to 108°, to 144° and to 180° (fully closed). The movement of each shutter 11*a*, 11*b* for a given rotation of the rotatable shaft 23 is set out in Table 1. The direction of movement with respect to a vertical reference axis [A] is indicated by the "-" symbol, with "-" indicating an inward angle of rotation from the vertical line of reference [A], i.e. towards a closed position:

TABLE 1

| Angle of rotation of rotatable shaft (°) | Angle of movement of first shutter (°) | Angle of movement of second shutter (°) |
|---|---|---|
| 0 | −8.74 | −8.74 |
| 36 | −0.86 | −5.43 |
| 72 | −2.35 | 8.93 |
| 108 | 7.83 | 22.81 |
| 144 | 22.55 | 32.49 |
| 180 | 34.73 | 32.52 |

As previously described, the movement of the crank mechanism 20 under the action of the motor-driven rotatable shaft 23 causes the shutters 11*a*, 11*b* to smoothly move between an open position [FIG. 4A] and an overlapping, closed position [FIG. 4F]. In the fully open position [FIG. 4A] the print curing window is at its maximum and in the fully closed position [FIG. 4F] radiation from the UV lamp 9 is blocked and no radiation reaches the substrate (not shown).

It is envisaged that different configurations of the crank mechanism 20; the links 21, 26; and the connector 24, 25 are used to achieve the required speeds of continuous movement of each shutter 11*a*, 11*b*, whilst controlling the degree of overlap between the first and second shutter 11*a*, 11*b*.

It is understood that, in the embodiment shown in FIGS. 4A-4F, the actuator continues to move the rotatable shaft 23 in a clockwise direction to travel between 180° and 360°. This causes the reverse motion of the crank mechanism 20 so that the shutters 11*a*, 11*b* move between the closed and an open position; i.e. the shutters 11*a*, 11*b* move away from each other to expose the substrate to UV radiation for print curing. Although it is possible for the rotatable shaft to move in both a clockwise and an anticlockwise direction; the direction of rotation of the rotatable shaft 23 to close the shutters is the same direction of rotation to close the shutters 11*a*, 11*b*, which allows for the continuous movement. It is the continuous movement of the rotatable shaft 23 and the resultant continuous movement of the crank mechanism 20, in the same direction of rotation that causes the full open-close-open cycle of movement of the shutters 11*a*, 11*b*.

Figure 6:
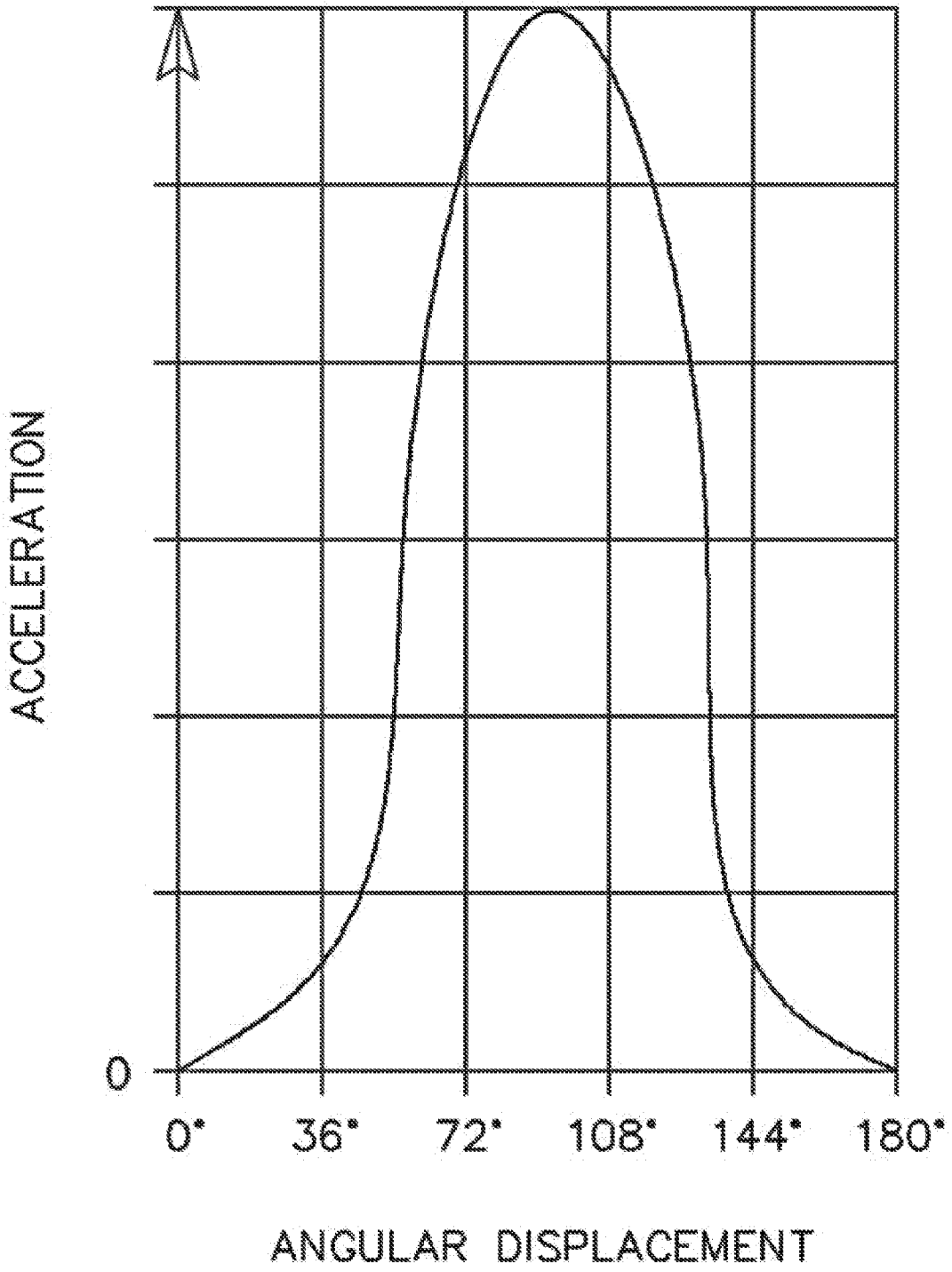
FIG. 6 is a graph showing the acceleration of each shutter over a cycle of movement of the rotatable shaft/actuator (between 0° and 180°).

Referring to FIG. 6, an example of the acceleration of each shutter 11*a*, 11*b* over a 180° cycle of angular displacement is shown. The acceleration of the shutter is at a peak mid-way through the cycle of movement between an open (0°) and a closed (180°) position, at about 93°. The speed of movement of the shutters 11*a*, 11*b* reduces significantly towards the open (0°) and closed (180°) positions. Thus the stress on the shutters 11*a*, 11*b* and the moving parts of the crank mechanism 20 at the two extremes of movement are much reduced.

Referring to FIG. 6 and FIGS. 4A-4F, each shutter 11*a*, 11*b* moves from an open to a closed position, but the speed at which each shutter 11*a*, 11*b* moves between the open and closed positions varies throughout the cycle. The movement and position of the first shutter 11*a* does not mirror the movement and position of the second shutter 11*b* throughout the cycle. The initial movement of each shutter 11*a*, 11*b* away from an open position is relatively slow; the speed increases when each shutter 11*a*, 11*b* is halfway between the open and closed positions; before the speed decreases, i.e. the shutter's movement decelerates to a stop as the shutters 11*a*, 11*b* approach the closed position. The variation in speed is such that the position of each shutter 11*a*, 11*b* is not symmetrical about the axis of the lamp 9 around which they move. The geometry of the crank mechanism 20 is carefully selected to ensure that the correct speed and position of movement of each shutter 11*a*, 11*b* is achieved. The geometry ensures that the first shutter 11*a* reaches the closed position before the second shutter 11*b*, as shown in FIGS. 4E-4F. Thus, in a closed position, the second shutter 11*b* overlaps the first shutter 11*a*.

Movement of the first shutter 11*a* from a closed to an open position also does not mirror the movement of the second shutter 11*b*. Thus, the arrangement of the present invention ensures that the shutters 11*a*, 11*b* do not allow radiation to pass to the substrate when they are in a closed position, but also ensures that the shutter 11*a*, 11*b* will not become jammed in a closed position. In the first stage of opening; i.e. when the rotatable shaft moves from 180° to about 216°, the second shutter 11*b* moves from a closed position to an open position before the first shutter 11*a*. The speed at which each shutter 11*a*, 11*b* moves between the closed and the open positions varies throughout the cycle. The movement and position of the first shutter 11*a* does not mirror the movement and position of the second shutter 11*b* throughout the opening cycle. Both shutters 11*a*, 11*b* slow down to a gentle stop as they reach the fully open position. Throughout the open-close-open cycle the rotatable shaft 23 continuously rotates and the crank mechanism 20 continuously moves even if, at some stages of the cycle, movement of the or each shutter 11*a*, 11*b* is minimal. This ensures that the movement of the shutter is at all times smooth and controlled.

The above described embodiment has been given by way of example only, and the skilled reader will naturally appreciate that many variations could be made thereto without departing from the scope of the claims.

The invention claimed is:

1. An ink curing apparatus comprising a UV lamp; at least two reflectors; and at least two moveable shutters, wherein movement of each shutter is between an open position exposing a substrate to UV radiation from the UV lamp and a closed position wherein the or each shutter shields the substrate from the UV radiation from the UV lamp, characterised in that each shutter is continuously moveable and is controlled by a crank mechanism; wherein the crank mechanism comprises at least two links attached to a rotatable shaft, wherein each link of the crank mechanism is attached to a connector, wherein each connector is attached to a shutter of the at least two moveable shutters, and wherein rotation of the rotatable shaft of the crank mechanism causes the at least two shutters to move away from each other towards a fully open position and continued rotation of the rotatable shaft of the crank mechanism in the same direction of rotation causes the at least two shutters to move towards each other towards a fully closed position.

2. An ink curing apparatus according to claim 1 wherein a first link of the two links is connected to a first shutter of the at least two moveable shutters and a second link of the two links is connected to a second shutter of the at least two shutters and wherein the length of the first link is less than the length of the second link.

3. An ink curing apparatus according to claim 2 wherein the crank mechanism is configured to move the first shutter slower than the second shutter; more preferably, wherein, the crank mechanism (20) is configured to reduce the speed of movement of the shutters when approaching the open and/or closed position.

4. An ink curing apparatus (1) according to claim 1 wherein the rotatable shaft of the crank mechanism is movable in a clock-wise or an anti-clockwise direction.

5. An ink curing apparatus according to claim 1 wherein the or each shutter has a curved profile; preferably wherein the or each shutter has a substantially elliptical profile.

6. An ink curing apparatus according to claim 1 wherein each reflector is connectable to one of the shutters; preferably wherein each reflector is removably connected to one of the shutters.

7. An ink curing apparatus according to claim 1 wherein the first shutter at least partially overlaps with the second shutter in a closed position.

8. A UV ink curing method comprising the steps of;

moving at least two shutters using a crank mechanism to an open position wherein a substrate is exposed to UV radiation;

emitting UV radiation from a UV lamp;

directing the UV radiation using at least two reflectors onto a substrate to be cured, moving each shutter using the crank mechanism to a closed position wherein the substrate is shielded from the UV radiation emitted from the UV lamp, characterised in that the movement of the crank mechanism and the associated movement of each shutter is continuous; wherein the crank mechanism comprises at least two links attached to a rotatable shaft, wherein each link of the crank mechanism is attached to a connector wherein each connector is attached to a shutter, and wherein rotation of the rotatable shaft of the crank mechanism causes the at least two shutters to move away from each other towards a fully open position and continued rotation of the rotatable shaft of the crank mechanism in the same direction of rotation causes the at least two shutters to move towards each other towards a fully closed position.

9. A UV ink curing method according to claim 8 wherein the speed of movement of each shutter is reduced when approaching the open or closed position.

10. A UV ink curing method according to claim 8 wherein movement of the crank mechanism is computer-controlled.

11. A UV ink curing method according to claim 8 wherein movement of the crank mechanism is stoppable at any point between the open and closed position.

12. A UV ink curing method according to claim 8 wherein movement of the crank mechanism is remotely controlled.

13. A UV ink curing method according to claim 8 wherein the ink curing method further comprises the steps of moving the at least two reflectors in combination with the or each shutter using the crank mechanism.

* * * * *